United States Patent [19]

Conti

[11] Patent Number: 4,534,479

[45] Date of Patent: Aug. 13, 1985

[54] TAMPER EVIDENT CONTAINER CLOSURE

[75] Inventor: Vincent N. Conti, West Hempstead, N.Y.

[73] Assignee: American Safety Closure Corp., Farmingdale, N.Y.

[21] Appl. No.: 640,900

[22] Filed: Aug. 15, 1984

[51] Int. Cl.[3] ..... B65D 49/12

[52] U.S. Cl. ..... 215/252; 215/258

[58] Field of Search ..... 215/252, 258

[56] References Cited

U.S. PATENT DOCUMENTS

| | | | |
|---|---|---|---|
| 3,463,341 | 8/1969 | Fields | 215/252 |
| 4,126,240 | 11/1978 | Brach | 215/252 |
| 4,174,044 | 11/1979 | Kimm et al. | 215/252 |
| 4,305,516 | 12/1981 | Perne et al. | 215/252 |
| 4,352,436 | 10/1982 | Chartier et al. | 215/252 |
| 4,457,437 | 7/1984 | Heath, Jr. | 215/252 X |
| 4,479,586 | 10/1984 | Csaszar | 215/252 X |

*Primary Examiner*—Steven M. Pollard

*Attorney, Agent, or Firm*—Pennie & Edmonds

[57] ABSTRACT

A tamper evident container closure for a container having a threaded mouth portion and a plurality of teeth members adjacent said mouth portion. The container closure comprises a threaded cap, a split ring, and an indicator member. The threaded cap is provided for engaging the mouth portion of the container. The split ring is located generally concentric with and slightly outside a lower portion of the cap and is frangibly connected thereto. The ring includes a plurality of pawls for engaging the teeth members of the container to inhibit twisting of the split ring as the cap is twisted off the container. The indicator member is rigidly secured to the cap and radially extends outward therefrom, between the spaced ends of the split ring, to rub against that ring as the cap is twisted off the container.

4 Claims, 5 Drawing Figures

TAMPER EVIDENT CONTAINER CLOSURE

BACKGROUND OF THE INVENTION

This invention generally relates to tamper indicating plastic container closures, and more specifically to a threaded cap having a ring frangibly connected to a lower edge thereof.

Tamper indicating container closures are widely used to demonstrate to the final consumer that the contents of a container have not been contaminated or adulterated subsequent to the time the closure was initially secured onto the container. One type of tamper indicating container closure comprises a threaded cap and a ring frangibly connected thereto. The ring, which may or may not be split, is located generally concentric with and slightly outside a lower portion of the cap, and the ring is connected thereto by means of a plurality of frangible members. The ring includes a multitude of inside pawl members, and the closure is intended for use with a container having a plurality of outside teeth that engage the inside pawls of the ring as the closure is twisted off the container. This engagement tends to break the frangible members connecting the ring to the cap, separating the ring therefrom. Closures of this type are described in greater detail in U.S. Pat. Nos. 4,062,466; 3,874,540; 3,504,818; and 3,249,247.

One difficulty with prior art closures of this type is that the frangible members connecting the ring to the cap do not always break as the cap is twisted off a container, and hence that the cap may be removed from the container with the ring still connected to that cap. In particular, this may happen if one or more of the frangible members connecting the ring to the cap sufficiently stretches, without breaking, to allow the pawls of the ring to slide past the teeth of the container. The ring of such a closure may remain in a position similar to its original position relative to the cap of the closure; generally concentric with and slightly outside the lower portion of that cap. If the closure is again secured to the container, a casual observer may not notice the broken or stretched frangible members and may mistakenly assume that the closure has not been removed from the container after the closure was initially secured or mounted thereon.

SUMMARY OF THE INVENTION

In accordance with the present invention, a tamper evident container closure is provided with a pair of tamper evident means. The first such means comprises a conventional split ring of the type that is frangibly connected to a cap of the closure and includes a plurality of inside pawls. The second tamper evident means comprises a pointer securely connected to the cap and extending radially outwardly therefrom generally midway between and closely adjacent to the ends of the split ring. The pointer is also frangibly connected to the split ring itself.

As the closure is twisted off a container, the pawls on the ring engage teeth on the container. This engagement at least initially prevents the split ring from rotating with the cap of the closure. This, in turn, causes the frangible members that connect the split ring to the cap to stretch and bend, tending to break those frangible members and, thus, separating the split ring from the cap. Even if the split ring does not completely break away from the cap, the initial twisting of the cap relative to the split ring, first, breaks the frangible connection between that ring and the pointer of the closure and, second, causes the pointer, which remains securely connected to the cap, to rub against the adjacent end of the split ring and deform the shape of that ring, for example, by coiling that end of the ring outward.

With this invention, even a casual observer generally familiar with the initial, or normal, shape and design of the split ring and the pointer can readily detect if the closure has been twisted off a container and then replaced thereon, even if the split ring did not completely break away from the cap as the latter was twisted off the container. This is so for several reasons.

First, as the cap is removed from the container, even if the split ring is not completely broken away from split ring the cap, the pointer is broken away from and moved relative to the ends of the split ring. It is very difficult as a practical matter to return the pointer to its original position centered between the ends of the split ring. The fact that the pointer has been moved relative to the ends of the split ring is comparatively easy to notice. This is so because, since those ends and the pointer are initially located relatively close together, a small movement, in absolute terms, of the pointer toward or away from either end of the split ring results in a large, readily noticed relative movement therebetween.

Second, as the cap is twisted off the container, the pointer of the closure rubs against and warps or deforms the shape of the split ring. It is very difficult, if not practically impossible, to reform the split ring into its original smooth, annular shape. At the same time, the fact that the shape of the split ring has been deformed or altered is easily recognized.

DETAILED DESCRIPTION OF THE PREFERRED EMBODIMENT

Figure 1:
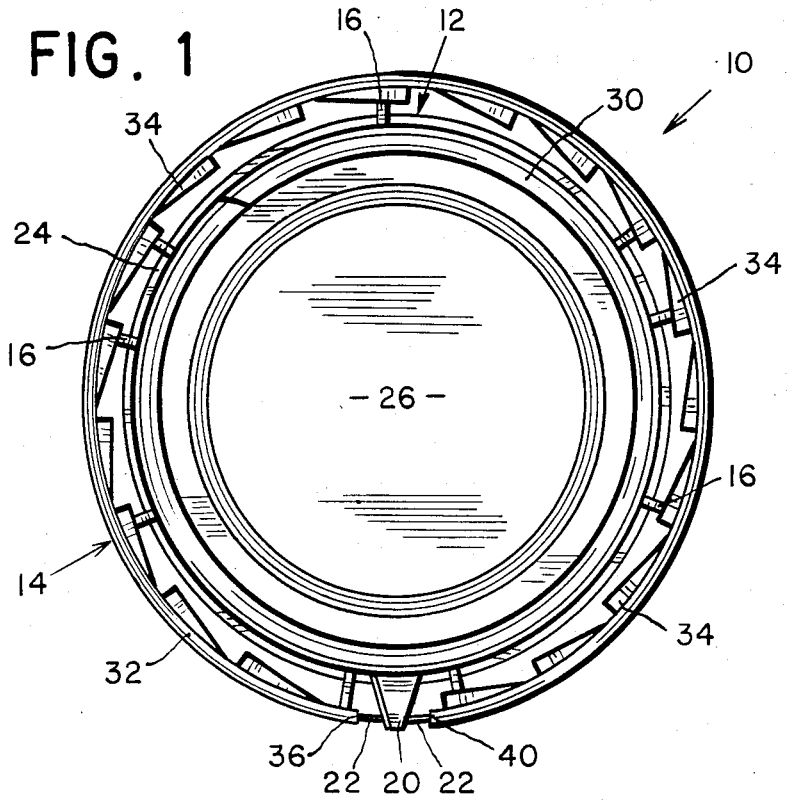
FIG. 1 is a bottom view of a closure in accordance with this invention.
Figure 2:
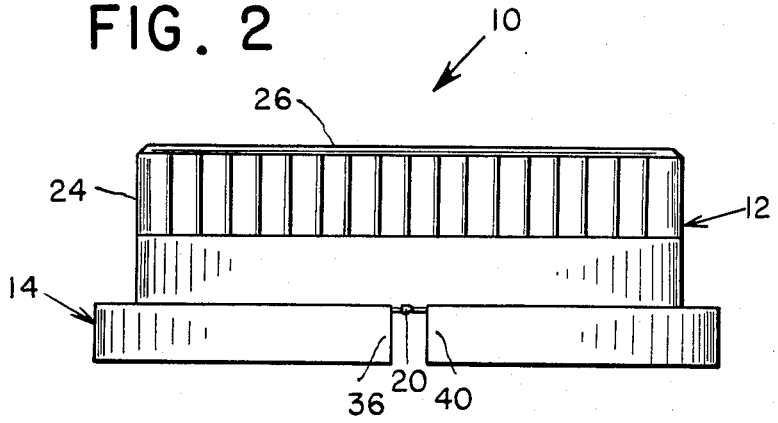
FIG. 2 is a side view of the closure illustrated in FIG. 1.
Figure 3:
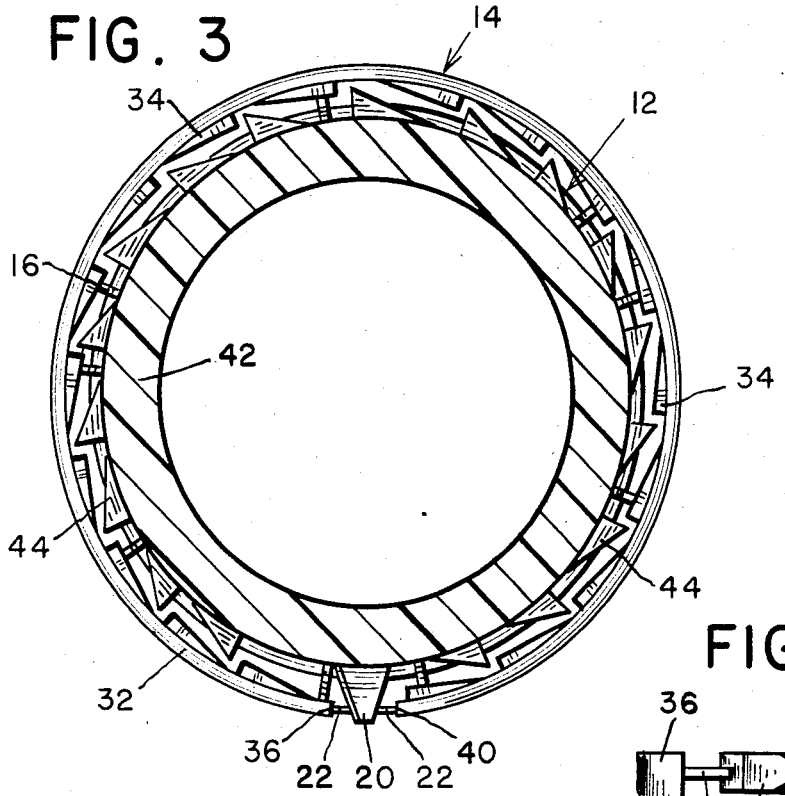
FIG. 3 is a bottom view similar to FIG. 1 and showing the closure secured to a container.
Figure 5:
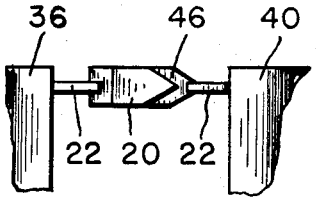
FIG. 5 is an enlarged view of the pointer of the closure, particularly showing the bevelled edge of the pointer.

FIGS. 1, 2 and 3 illustrate a plastic container closure 10 generally comprising a cap 12, a ring 14, a plurality of frangible members 16, a pointer 20, and a pair of frangible fingers 22. More specifically, the cap 12 includes a cylindrical side wall 24, a top wall 26 which diametrically extends across the top of the cylindrical side wall, and an internal thread 30 that projects radially inward from the cylindrical side wall of the cap. The ring 14 is located outside and adjacent a bottom circumferential edge of the cap 12, generally concentric therewith, and the ring includes a main annular portion 32 and a multitude of triangularly shaped pawls 34 that are generally uniformly spaced around and extend inwardly radially from the main annular portion of the split ring. A plurality, for example 9, frangible members 16 are spaced around the bottom of the cap 12 and extend radially between that cap and the ring 14 to connect the ring breakably thereto. The closure 10 is a one piece body fabricated or molded from a relatively rigid plastic such as polypropelene.

The pointer 20 is securely connected to the cap 12 and extends radially outwardly therefrom, closely adjacent and generally midway between the spaced apart annular ends 36, and 40 of the split ring 14. The pointer 20 has a generally triangularly shaped horizontal cross-sectional area, with the base of the triangle contiguous and securely connected to the side wall 24 of the cap 12 and the sides of that triangle extending outwardly therefrom. The frangible fringers 22 extend between the pointer 20 and the ends 36 and 40 of the ring 14, directly along the annular path formed by the split ring 14, breakably connecting the pointer thereto.

With particular reference to FIG. 3, closure 10 is manufactured for use with a bottle or similar container having a threaded mouth or neck portion 42 for threadably receiving the cap 14 thereon. The neck of the container also has a plurality of teeth 44 for engaging the pawls 34 of the ring 14. The closure 10 is secured to the bottle or container simply by pressing the closure onto the mouth portion 42 or by twisting the closure member onto the container in a forward direction—counterclockwise as viewed in FIG. 3. In twisting the cap 12 onto the container, the leading sloped surfaces of the pawls 34 slide over the container teeth 44. The closure 10 is removed from the container by twisting the cap 12 rearward—clockwise as viewed in FIG. 3. In this direction, the leading surfaces of the pawls 34 interlock with the container teeth 44 to resist twisting of the ring 14.

Because of this resistance, as the cap 12 is twisted off the container neck 42, initially the ring 14 is held stationary relative to the container neck 42. This produces shearing forces on the frangible members 16, normally breaking those frangible members and separating the split ring 14 from the cap 12. Occasionally, however, the shearing forces do not break all the frangible members 16 and, instead, one or more of those frangible members stretch and pull the pawls 34 past the teeth 44 without completely breaking. When this happens, the ring 14 remains connected the cap 12 as the cap is removed from the container.

Even if this happens, during the initial twisting of the cap 12, when engagement between the pawls 34 and the teeth 44 prevents rotation of the ring 14 relative to the cap 12, the pawls slide radially outwardly along the teeth of the container neck 42, expanding the ring 14. As this happens, the ends 36 and 40 of split ring 14 move both radially outwardly and annularly away from each other, stretching and bending the frangible fingers 22. This bending and stretching of the frangible fingers 22, in combination with other forces applied thereto as the result of the relative twisting between the split ring 14 and the cap 12, breaks those frangible fingers, separating the pointer 20 from the split ring. The immediately subsequent twisting of the cap 14 brings the pointer 20, which rotates unitarily with the cap 20, into engagement with the adjacent end 36 of the split ring 14, forcing that end of the ring to coil outward.

Figure 4:
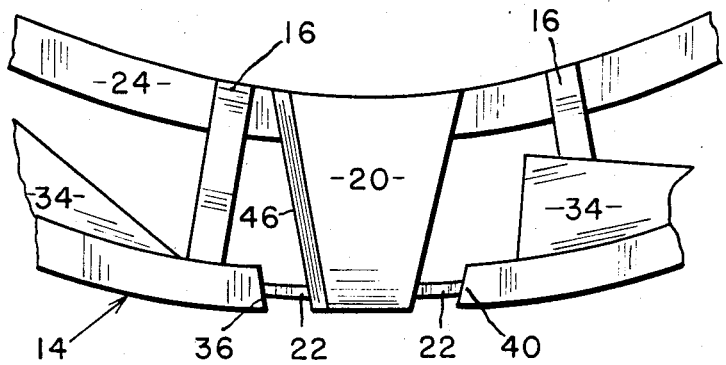
FIG. 4 is an enlarged view of a portion of the closure shown in FIGS. 1, 2 and 3, illustrating the pointer of that closure in greater detail.

Preferably, as is believed best understood from a review of FIGS. 3 and 4, the front radial edge 46 of the pointer 20 and the immediately adjacent end 36 of the ring 14 both slant forwardly radially outwardly. These angled, complementary edges facilitate pushing the end 36 of the split ring 14 outward as the pointer 20 moves or comes into engagement with that end of the split ring. This, in turn, helps to insure that the end 36 of the split ring 14 is pushed visably outward when cap 12 is removed from container neck 42.

Also, this front edge 46 of pointer 20 is preferably bevelled to form a knife edge. This knife edge is of utility because it helps to insure that the frangible member 16 immediately rearward of the edge 46 is broken as cap 12 is twisted off the container neck 42. To elaborate, during initial twisting of the cap 12—after frangible fingers 22 are broken and while the ring 14 is prevented from rotating about the container neck 42 because of the engagement between the pawls 34 and the teeth 44—in case the frangible member immediately rearward of the pointer 20 does not readily break, edge 46, which rotates unitarily with the cap 12, engages and slices or cuts into that adjacent frangible member 16. This, at the very least, weakens that adjacent frangible member 16, insuring that the frangible member is broken by the other forces applied thereto during the initial relative twisting between the cap 12 and the ring 14.

I claim:

1. A tamper evident container closure for a container having a threaded mouth portion and a plurality of teeth members adjacent said mouth portion, said container closure comprising:

(a) a threaded cap for engaging the mouth portion of the container;

(b) a split ring including (i) first and second adjacent spaced ends, and (ii) a plurality of pawls for interlockably engaging the teeth members of the container to inhibit twisting of the split ring off the mouth portion of the container as the cap is twisted off said mouth portion;

(c) a plurality of frangible members radially extending between the split ring and the cap to connect the split ring breakably thereto;

(d) a pointer connected to the cap and radially extending outward therefrom, generally midway between the spaced ends of the split ring, to engage the ring as the cap is twisted relative thereto; and (e) at least one frangible finger circumferentially extending between the pointer and an end of the split ring to connect the pointer breakably thereto.

2. A tamper evident container closure according to claim 1 wherein:

(a) the closure is twisted in a forward direction to secure the closure onto the container, and twisted in a rearward direction to remove the closure from the container;

(b) the pointer includes a front edge located adjacent and rearward of the first end of the split ring; and (c) the front edge of the pointer and the first end of the split ring slant forwardly radially outwardly to facilitate forcing the first end of the split ring radially outward as the pointer engages the first end of the split ring.

3. A tamper evident container closure according to claim 2 wherein:

(a) a first frangible member is located rearward of and adjacent the pointer; and (b) the front edge of the pointer is bevelled to cut the first frangible member as the closure is twisted off the container.

4. A tamper evident container closure according to claim 3 wherein the frangible finger extends directly between the pointer and an end of the split ring, directly along an annular path formed by the split ring.

* * * * *